US005932518A

United States Patent [19]

Evans et al.

[11] Patent Number: 5,932,518

[45] Date of Patent: Aug. 3, 1999

[54] DYE-DONOR ELEMENT FOR THERMAL DYE TRANSFER

[75] Inventors: Steven Evans, Rochester; Ellen M. Pyszczek, LeRoy; Helmut Weber, Webster, all of N.Y.

[73] Assignee: Eastman Kodak Company, Rochester, N.Y.

[21] Appl. No.: 08/996,388

[22] Filed: Dec. 22, 1997

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 3,992,140 11/1976 Psaar ..... 8/2.5
5,698,490 12/1997 Ito et al. ..... 503/227

FOREIGN PATENT DOCUMENTS 0 785 087 A1 7/1997 European Pat. Off. ..... 503/227

*Primary Examiner*—Bruce H. Hess
*Attorney, Agent, or Firm*—Harold E. Cole

[57] ABSTRACT

A dye-donor element comprising a support having on one side thereof a dye layer comprising a dye precursor dispersed in a polymeric binder, the dye precursor having the following structure:

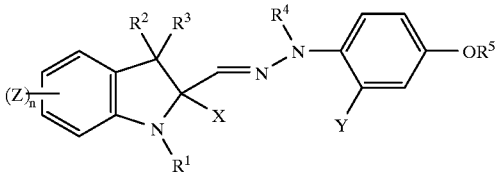

and the support having on the other side thereof a slipping layer.

18 Claims, No Drawings

DYE-DONOR ELEMENT FOR THERMAL DYE TRANSFER

FIELD OF THE INVENTION

This invention relates to a dye-donor element for thermal dye transfer which contains a certain hydrophobic dye precursor, derived from an azamethine cationic dye.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye-receiver polymer should have good affinity for the dye and provide a stable (to heat and light) environment for the dye after transfer. In particular, the transferred dye image should be resistant to image degradation by contact with other surfaces, chemicals, fingerprints, etc. Such image degradation is often the result of continued migration of the transferred dyes after the printing step.

Commonly used dyes are nonionic in character because of the easy thermal transfer achievable with this type of compound. The dye-receiver layer usually comprises an organic polymer with polar groups to accept the dyes transferred to it. A disadvantage of such a system is that, since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species because it is very polar and hydrophilic.

DESCRIPTION OF RELATED ART

EPA 785087 describes dye precursors which can regenerate a cationic dye upon thermal transfer to a dye-receiving element containing an organic acid. There is a problem with these dye precursors, however, in that they have poor light stability, as will be shown below.

U.S. Pat. No. 3,992,140 relates to dye precursors, similar to those described herein, for transfer printing onto acid-modified textile fiber materials. The transfer printing process takes from 15 to 60 seconds. However, there is no disclosure in this patent of the use of these materials in a dye-donor element for a thermal dye transfer process as described herein using a thermal print head.

It is an object of this invention to provide a dye-donor element for a thermal dye transfer process and an assemblage employing a dye-precursor which will provide the desired hue upon transfer and which will have good stability to light.

SUMMARY OF THE INVENTION

These and other objects are achieved in accordance with this invention which relates to a dye-donor element comprising a support having on one side thereof a dye layer comprising a dye precursor dispersed in a polymeric binder, the dye precursor having the following structure:

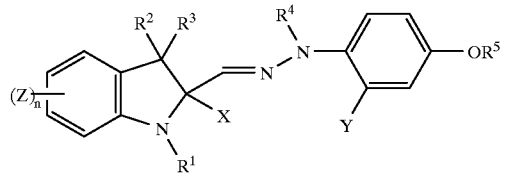

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

Y and Z each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

n represents an integer of from 1–4;

X and $R^1$ may be combined together with the atoms to which they are attached to form a 5–7 membered ring, such as perhydropyrimid-3-one, oxazolidine or perhydrooxazine;

any two of Z may be combined to form additional fused rings; and $R^2$ and $R^3$ may be combined together to form a 5–7 membered ring, such as cyclopentane, cyclohexane or tetrahydrofuran; and the support having on the other side thereof a slipping layer.

DESCRIPTION OF THE PREFERRED EMBODIMENTS

Specific examples of dye precursors used in the invention have the following structure:

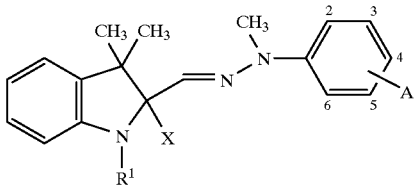

(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

Dye-donor elements used in the invention conventionally comprise a support having thereon a dye layer containing the

TABLE 1

| Dye Precursor | $R^1$ | X | A | Molecular Weight | λ-max (nm) (ε-max)[1] |
|---|---|---|---|---|---|
| 1 | $CH_3$ | OH | 4-$OCH_3$ | 339 | 449 (36,300) |
| 2 | —$CH_2CH_2CONH$— | | 2,4-$(OCH_3)_2$ | 408 | 426 (31,500) |
| 3 | —$CH_2CH_2O$— | | 4-$OC_6H_5$ | 413 | 444 (39,100) |
| 4 | —$CH_2CH_2CONH$— | | 4-$OCH_3$ | 378 | 455 (38,100) |
| 5 | —$CH_2CH_2O$— | | 4-$OCH_3$ | 351 | 455 (36,000) |
| 6 | —$CH_2CH(CH_2OH)O$— and —$CH_2CH(OH)CH_2O$— (mixture) | | 4-$OC_6H_5$ | 443 | 446 (38,900) |
| 7 | —$CH_2CH(CH_2OH)O$— —$CH_2CH(OH)CH_2O$— (mixture) | | 2,4-$(OCH_3)_2$ | 411 | 422 (29,300) |
| 8 | —$CH_2CH_2O$— | | 4-$OCH_2CONHCH_3$ | 408 | 448 (38,100) |

[1]In ethanol containing HCl, ε = molar absorbtivity

In a preferred embodiment of the invention, $R^2$, $R^3$ and $R^4$ are each methyl. In another preferred embodiment of the invention, $R^5$ is methyl or phenyl. In still another preferred embodiment of the invention, $R^1$ is methyl and X is hydroxyl. In yet another preferred embodiment of the invention, Y is methoxy. In still yet another preferred embodiment of the invention, $R^1$ and X are combined together with the atoms to which they are attached to form a 5–7 membered ring.

The above dye precursors are not new and may be prepared by the procedures given in U.S. Pat. Nos. 4,372,886; 3,999,939; 3,860,583 and 4,847,378 referred to above.

The dye precursors described above may be employed in any amount effective for the intended purpose. In general, good results have been obtained when the dye precursor is present in an amount of from about 0.05 to about 1.0 g/m$^2$, preferably from about 0.1 to about 0.5 g/m$^2$. Mixtures may also be used.

We have found that the hydrophobic dye precursors employed in the invention which are derived from hydrophilic cationic dyes are very useful in thermal transfer imaging. These dye precursors are soluble in organic solvents and compatible with common binder polymers. When transferred to acidic dye-receiving elements, the color of the cationic dye is rapidly regenerated and very high density images with surprisingly good light stability are produced, in contrast to the dye precursors of EPA 785087.

Any material can be used as the support for the dye-donor element employed in the invention, provided it is dimensionally stable and can withstand the heat of the thermal print heads. Such materials include polyesters such as poly dye precursors as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

The reverse side of the dye-donor element of the invention is coated with a slipping layer to prevent the printing head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, perfluorinated alkyl ester polyethers, polycaprolactone, silicone oil, polytetrafluoroethylene, carbowax, poly(ethylene glycols), or any of those materials disclosed in U.S. Pat. Nos. 4,717,711; 4,717,712; 4,737,485 and 4,738,950. Suitable polymeric binders for the slipping layer include poly (vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

An assemblage according to the invention comprises:

(I) the dye-donor element described above, and (II) a dye-receiving element comprising a support having thereon a polymeric dye image-receiving layer, the dye-receiving element being in a superposed relationship with the dye-donor element so that the dye layer is in contact with the polymeric dye image-receiving layer, the dye-image receiving layer containing an acidic substance capable of converting the dye precursor into a cationic dye.

Any type of polymer may be used in the dye-receiver employed in the invention, e.g., condensation polymers such as polyesters, polyurethanes, polycarbonates, polyamides, etc.; addition polymers such as polystyrenes, vinyl polymers, etc.; block copolymers containing large segments of more than one type of polymer covalently linked together; provided such polymeric material contains acid groups either as part of the polymer chain or as a separately added organic acid. In a preferred embodiment of the invention, the dye image-receiving layer comprises a polyester, an acrylic polymer, a styrene polymer, a polyamide or a phenolic resin.

The dye image-receiving layer of the dye-receiver employed in the invention may contain an organic acid, such as a sulfonic acid, a carboxylic acid, a phosphonic acid, a phosphoric acid, or a phenol as part of the polymer chain, or may contain a separately added organic acid. The polymeric dye image-receiving layer acts as a matrix for the deprotonated dye and the acid functionality within the dye image-receiving layer will concurrently cause reprotonation and regeneration of the parent cationic dye. For various ways in which acid moieties can be incorporated into a dye-receiver, reference is made to U.S. Pat. Nos. 5,523,274; 5,534,479 and 5,627,128, the disclosures of which are hereby incorporated by reference.

Organic acids which can be separately added to the polymer to provide its acidic nature generally comprise ballasted organic acids, e.g., carboxylic acids such as palmitic acid, 2-(2,4-di-tert-amylphenoxy)-butyric acid, etc.; phosphonic/phosphoric acids such as monolauryl ester of phosphoric acid, dioctyl ester of phosphoric acid, dodecylphosphonic acid, etc.; sulfonic acids such as hexadecanesulfonic acid, p-octyloxybenzene-sulfonic acid; a phenol such as 3,5-di-tert-butyl-salicylic acid, etc.

Inorganic acids may also be added to the dye-receiving layer to provide its acidic nature. There may be used, for example, hydrated transition metals or metalloid salts of a strong acid such as those materials disclosed in copending application Ser. No. 08/879,061, filed Jun. 19, 1997, by Guistina et al. In a preferred embodiment, aluminum sulfate or zinc nitrate is used.

The following dye-receiver polymers may be used in accordance with the invention:

poly(butyl acrylate-co-2-acrylamido-2-methylpropanesulfonic acid) 75:25 poly(2-ethylhexyl acrylate-co-2-acrylamido-2-methylpropanesulfonic acid) 75:25 poly(2-ethylhexyl methacrylate-co-2-acrylamido-2-methylpropanesulfonic acid) 75:25 poly(2-hexyl methacrylate-co-2-acrylamido-2-methylpropanesulfonic acid) 75:25 poly(butyl acrylate-co-methyacrylic acid) 75:25 poly(butyl acrylate-co-2-acrylamido-2-methylpropanesulfonic acid-co-methyl 2-acrylamido-2-methoxyacetate) 65:25:10 poly(hexyl methacrylate-co-2-sulfoethyl methacrylate-co-2-acrylamido-2-methoxyacetate) 65:25:10 polystyrenesulfonic acid poly(ethyl methacrylate-co-2-sulfoethyl methacrylate) 75:25 poly(methyl methacrylate-co-2-sulfoethyl methacrylate) 75:25

N-15 Novolak (a phenolic resin, Eastman Chemical Co.)

Poly(2-phenylethyl methacrylate) (Scientific Polymer Products Inc.) containing 3,5-di-t-butyl-salicylic acid poly(butyl acrylate-co-allyl methacrylate-co-2-sulfoethyl methacrylate, sodium salt) 93:2:5 wt. core/poly(glycidyl methacrylate) 10 wt. shell, (Tg=−40° C.)

poly[isophthalatic acid-co-5-sulfoisophthalic acid, sodium salt (90:10 molar ratio)-diethylene glycol (100 molar ratio)]

poly(ethyl acrylate-co-fluoroalkyl methacrylate-co-2-acrylamido-2-methyl-propanesulfonic acid, sodium salt) (50:45:5 wt. ratio)

The polymer in the dye image-receiving layer may be present in any amount which is effective for its intended purpose. In general, good results have been obtained at a concentration of from about 0.5 to about 10 g/m$^2$. The polymers may be coated from organic solvents or water, if desired.

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239 and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of at least one of the dyes, as described above, capable of generating a cyan, magenta, or yellow dye image, and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB 2,083,726A.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

The following control and comparison dyes were employed in the examples:

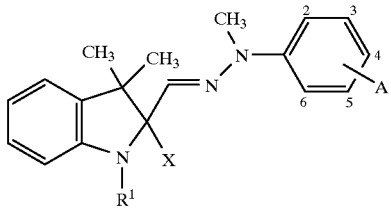

| Dye Precursor | $R^1$ | X | A | Molecular Weight | λ-max (nm) (ε-max)[1] |
|---|---|---|---|---|---|
| C-1 control dye precursor II-1 of EP 785087 | $CH_3$ | OH | 4-$CH_3$ | 323 | 437 (39,000) |
| C-2 comparative example | $CH_3$ | OH | 3-$OCH_3$ | 339 | 434 (37,800) |
| C-3 comparative example | $CH_3$ | OH | 3,4-$(OCH_3)_2$ | 369 | 459 (33,500) |
| C4 comparative example | $CH_3$ | OH | 2,5-$(OCH_3)_2$ | 369 | 413 (29,100) |
| C-5 comparative example | $CH_3$ | OH | H | 309 | 430 (39,600) |
| C-6 comparative example | $CH_3$ | OH | 3-$OCH_2O$-4 | 353 | 454 (32,600) |
| C-7 comparative example | —$CH_2CH_2O$— | | 4-$CH_3$ | 335 | 437 (40,200) |
| C-8 comparative example | —$CH_2CH_2CONH$— | | 4-$CH_3$ | 362 | 442 (38,800) |

[1]In ethanol containing HCl, ε = molar absorbtivity

The following control dyes were also prepared and evaluated.

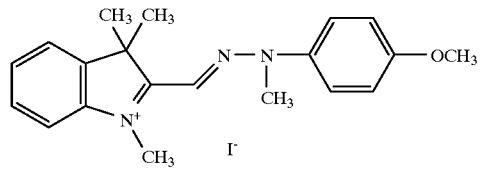

Control Dye C-9 (U.S. Pat. No. 4,664,671, "Ink 3") ε(450)=37,200 (in ethanol) Molecular weight=449

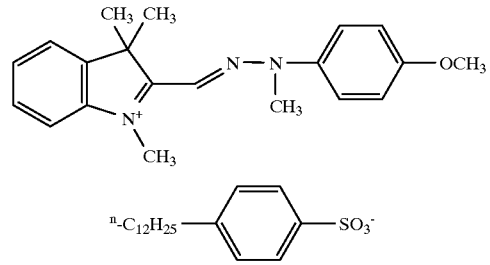

Control Dye C-10 (EPA 580120, Example 2) ε(449)=36,400 (in ethanol) Molecular weight=647

Preparation of Dye-Donor Elements

Individual donor elements were prepared by coating the following compositions in the order listed on a 6 μm poly(ethylene terephthalate) support:

1) a subbing layer of Polymin P®, (BASF Corp.) (0.04 g/m$^2$) and poly(butyl acrylate-co-allylmethacrylate) (98:2) 90 wt core/poly(glycidyl methacrylate) 10 wt. shell (0.01 g/m$^2$) coated from water; and 2) a layer containing the dye precursors of the invention or the control dyes of the prior art described above, and FC-431® fluorocarbon surfactant (3M Company) (0.01 g/m$^2$) in a poly(vinyl butyral) binder (Butvar B-76®, Monsanto Company) coated from a toluene/n-propanol/cyclohexanone (65/30/5) solution.

Details of dye precursor (or control dye) laydowns are collected in Table 2. Dye/dye precursor levels were adjusted based on molecular weight and molar absorption. The poly (vinyl butryal) laydown was twice (2×) the level of the dye or dye precursor level in all cases.

On the back side of the dye-donor element were coated the following compositions in the order listed:

1) a subbing layer of Tyzor TBT®, a titanium tetrabutoxide, (DuPont Company) (0.16 g/m$^2$) coated from 1-butanol; and 2) a slipping layer of Emralon 329® (v (Acheson Colloids Co.), a dry film lubricant of polytetrafluoroethylene particles in a cellulose nitrate resin binder (0.54 g/m$^2$) and S-nauba micronized carnauba wax (0.016 g/m$^2$) coated from a n-propyl acetate, toluene, isopropyl alcohol, and n-butyl alcohol solvent mixture.

TABLE 2

| Donor Element | Dye Precursor or Control Dye (g/m$^2$) |
|---|---|
| I-1 | 1 (0.29) |
| I-2 | 2 (0.40) |
| I-3 | 3 (0.33) |
| I-4 | 4 (0.31) |

TABLE 2-continued

| Donor Element | Dye Precursor or Control Dye ($g/m^2$) |
|---|---|
| I-5 | 5 (0.30) |
| I-6 | 6 (0.35) |
| I-7 | 7 (0.43) |
| I-8 | 8 (0.33) |
| C-1 | C-1 (0.28) |
| C-2 | C-2 (0.28) |
| C-3 | C-3 (0.34) |
| C-4 | C-4 (0.39) |
| C-5 | C-5 (0.24) |
| C-6 | C-6 (0.34) |
| C-7 | C-7 (0.26) |
| C-8 | C-8 (0.29) |
| C-9 | C-9 (0.37) |
| C-10 | C-10 (0.55) |

Preparation of Acidic Dye Receiving Element

The receiving element described below was prepared by first extrusion-laminating a paper core with a 38 $\mu$m thick microvoided composite film (OPPalyte 350TW®, Mobil Chemical Co.) as disclosed in U.S. Pat. No. 5,244,861.

The composite film side of the above laminate was coated with the following layers in the order recited:

1) a subbing layer of Prosil® 221, an aminopropyltriethoxysilane, (0.05 $g/m^2$) and Prosil® 2210, an amino-functional epoxysilane, (0.05 $g/m^2$) (both available from PCR, Inc.) coated from 3A alcohol; and 2) a receiving layer composed of a mixture of poly(butyl acrylate-co-allylmethacrylate-co-2-acrylamido-2-methylpropanesulfonic acid, sodium salt (93:2:5)) (2.82 $g/m^2$), AQ29D®, a polyester ionomer (Eastman Chemical Co.) (1.42 $g/m^2$), $Al_2(SO_4)_3$ 18 $H_2O$ (0.52 $g/m^2$), Synfac® 8216, a nonionic aryl polyoxyethylene ether surfactant available from Millikan Chemical, (0.47 $g/m^2$), ML160, a carnauba wax dispersion available from Michelman Chemical, (0.47 $g/m^2$) and poly(ethyl acrylate-co-Zonyl-TM®-2-acrylamido-2-methyl-propanesulfonic acid, sodium salt) (50:45:5), (0.22 $g/m^2$) coated from water. Zonyl-TM® is a fluoroalkyl methacrylate monomer available from DuPont.

Preparation and Evaluation of Thermal Dye Transfer Images

Eleven-step sensitometric thermal dye transfer images were prepared from the above donor and receiving elements. The dye side of the donor element approximately 10 cm×15 cm in area was placed in contact with a receiving-layer side of a receiving element of the same area. This assemblage was clamped to a stepper motor-driven, 60 mm diameter rubber roller. A thermal head (TDK No. 8I0625, thermostatted at 25° C.) was pressed with a force of 24.4 Newton (2.5 kg) against the donor element side of the assemblage, pushing it against the rubber roller.

The imaging electronics were activated causing the donor-receiving assemblage to be drawn through the printing head/roller nip at 40.3 mm/sec. Coincidentally, the resistive elements in the thermal print head were pulsed for 127.75 $\mu$sec/pulse at 130.75 $\mu$sec intervals during a 4.575 msec/dot printing cycle (including a 0.391 msec/dot cool down interval). A stepped image density was generated by incrementally increasing the number of pulses/dot from a minimum of 0 to a maximum of 32 pulses/dot. The voltage supplied to the thermal head was approximately 13.0 v resulting in an instantaneous peak power of 0.318 watt/dot and a maximum total energy of 1.30 mJ/dot. Print room humidity: 40%–45% RH.

After printing, the donor element was separated from the imaged receiving element and placed into an oven at 50° C./50% RH for 3 hours to ensure that the dye was evenly distributed throughout the receiving layer. After incubation, the Status A blue reflection densities of each of the eleven steps in the stepped-image were measured with an X-Rite 820 reflection densitometer. Table 3 lists the maximum density value (D-max).

The imaged receiving element from above was then subjected to fading by a 50 kLux, 5400° K. light source at 32° C. and approximately 25% relative humidity and the Status A blue reflection densities of the eleven steps in the stepped image were remeasured. The dye losses from an initial density of approximately 1.0 expressed as a percentage loss were calculated and listed in Table 3.

TABLE 3

| Donor Element | Maximum Transfer Density (D-max Status A blue) | Light fade (% Loss from 1.0, Status A blue density) |
|---|---|---|
| 1 | 1.8 | 7 |
| 2 | 1.5 | 4 |
| 3 | 2.1 | 5 |
| 4 | 1.7 | 4 |
| 5 | 2.1 | 4 |
| 6 | 1.7 | 6 |
| 7 | 1.7 | 5 |
| 8 | 1.7 | 5 |
| C-1 | 2.1 | 49 |
| C-2 | 2.1 | 80 |
| C-3 | 1.8 | 88 |
| C-4 | 1.5 | 37 |
| C-5 | 2.1 | 78 |
| C-6 | 1.7 | 90 |
| C-7 | 2.1 | 21 |
| C-8 | 1.3 | 27 |
| C-9 | 1.2 | not measured |
| C-10 | 1.6 | not measured |

The above data show that the dye precursors of the invention more efficiently (give higher D-max values) than do the cationic dye salts (dye donors C-9 and C-10) of the prior art. The comparison of donor elements I-1, I-4 and I-5 with C-9 and C-10 is particularly relevant since all of these donors deliver the same final cationic dye to the receiving element.

The data in Table 3 also show that the dye precursors of the invention yield much more light stable images than the dye precursors of the prior art when transferred to an acidic receiving element.

The invention has been described in detail with particular reference to preferred embodiments thereof, but it will be understood that variations and modifications can be effected within the spirit and scope of the invention.

What is claimed is:

1. A dye-donor element comprising a support having on one side thereof a dye layer comprising a dye precursor dispersed in a polymeric binder, said dye precursor having the following structure:

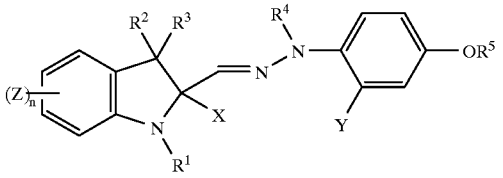

wherein:

$R^1$, $R^2$, $R^3$, $R^4$ and $R^5$ each independently represents a substituted or unsubstituted alkyl group of from 1 to about 10 carbon atoms, a substituted or unsubstituted aryl group of from about 6 to about 10 carbon atoms, a substituted or unsubstituted hetaryl group of from about 5 to about 10 atoms or a substituted or unsubstituted allyl group;

X represents —OR, —$N(R)_2$, —NRCOR, —$NRSO_2R$, —SR, —$SO_2R$, —S(O)R, —$O_2CR$, —$NRCON(R)_2$, —$OCON(R)_2$, —$SO_2N(R)_2$ or —NRCOOR; wherein each R independently represents H or $R^1$;

Y and Z each independently represents R, halogen, CN, alkoxy, aryloxy, alkylthio, arylthio, alkoxycarbonyl, aryloxycarbonyl, acylamino, sulfonylamino, nitro, alkylsulfonyl, arylsulfonyl or thiocyano;

n represents an integer of from 1–4;

X and $R^1$ may be combined together with the atoms to which they are attached to form a 5–7 membered ring;

any two of Z may be combined to form additional fused rings; and $R^2$ and $R^3$ may be combined together to form a 5–7 membered ring; and said support having on the other side thereof a slipping layer.

2. The dye-donor element of claim 1 wherein $R^2$, $R^3$ and $R^4$ are each methyl.

3. The dye-donor element of claim 1 wherein $R^5$ is methyl or phenyl.

4. The dye-donor element of claim 1 wherein $R^1$ is methyl and X is hydroxyl.

5. The dye-donor element of claim 1 wherein Y is methoxy.

6. The dye-donor element of claim 1 wherein $R^1$ and X are combined together with the atoms to which they are attached to form a 5–7 membered ring.

7. A process of forming a dye transfer image comprising imagewise-heating the dye-donor element of claim 1, and imagewise transferring a dye to a dye-receiving element comprising a support having thereon a polymeric dye image-receiving layer, said dye-receiving element being in a superposed relationship with said dye-donor element so that said dye layer is in contact with said polymeric dye image-receiving layer, said dye-image receiving layer containing an acidic substance capable of converting said dye precursor into a cationic dye to form said dye transfer image.

8. The process of claim 7 wherein $R^2$, $R^3$ and $R^4$ are each methyl.

9. The process of claim 7 wherein $R^5$ is methyl or phenyl.

10. The process of claim 7 wherein $R^1$ is methyl and X is hydroxyl.

11. The process of claim 7 wherein Y is methoxy.

12. The process of claim 7 wherein $R^1$ and X are combined together with the atoms to which they are attached to form a 5–7 membered ring.

13. A thermal dye transfer assemblage comprising:

(I) the dye-donor element of claim 1 and (II) a dye-receiving element comprising a support having thereon a polymeric dye image-receiving layer, said dye-receiving element being in a superposed relationship with said dye-donor element so that said dye layer is in contact with said polymeric dye image-receiving layer, said dye-image receiving layer containing an acidic substance capable of converting said dye precursor into a cationic dye to form said dye transfer image.

14. The assemblage of claim 13 wherein $R^2$, $R^3$ and $R^4$ are each methyl.

15. The assemblage of claim 13 wherein $R^5$ is methyl or phenyl.

16. The assemblage of claim 13 wherein $R^1$ is methyl and X is hydroxyl.

17. The assemblage of claim 13 wherein Y is methoxy.

18. The assemblage of claim 13 wherein $R^1$ and X are combined together with the atoms to which they are attached to form a 5–7 membered ring.

* * * * *